US010974160B2

(12) United States Patent
Brezan et al.

(10) Patent No.: US 10,974,160 B2
(45) Date of Patent: Apr. 13, 2021

(54) INFLATABLE BEAM AND USE OF THIS INFLATABLE BEAM

(71) Applicant: ZEPELIN, S.R.O., Trenčín (SK)

(72) Inventors: Juraj Brezan, Trenčín (SK); Henrich Hodák, Trenčín (SK); Pavol Ochodnický, Trenčín (SK)

(73) Assignee: ZEPELIN, S.R.O., Trencin (SK)

( * ) Notice: Subject to any disclaimer, the term of this patent is extended or adjusted under 35 U.S.C. 154(b) by 0 days.

(21) Appl. No.: 16/485,321

(22) PCT Filed: Feb. 13, 2018

(86) PCT No.: PCT/SK2018/050003
§ 371 (c)(1),
(2) Date: Aug. 12, 2019

(87) PCT Pub. No.: WO2018/151685
PCT Pub. Date: Aug. 23, 2018

(65) Prior Publication Data

US 2019/0374870 A1 Dec. 12, 2019

(30) Foreign Application Priority Data

Feb. 14, 2017 (SK) ..... 50015-2017 U

(51) Int. Cl.
*A63J 1/00* (2006.01)
*A63J 3/00* (2006.01)
(Continued)

(52) U.S. Cl.
CPC . *A63J 1/00* (2013.01); *A63J 3/00* (2013.01); *E01D 15/122* (2013.01); *E04C 3/005* (2013.01); *E04C 3/46* (2013.01); *E04H 2015/201* (2013.01)

(58) Field of Classification Search
CPC .. A63J 1/00; A63J 3/00; E01D 15/122; E04C 3/005; E04C 3/46; E04H 2015/201; E04H 15/20
See application file for complete search history.

(56) References Cited

U.S. PATENT DOCUMENTS 2,812,769 A * 11/1957 Schaefer ..... E04H 15/20 52/2.15
3,332,177 A * 7/1967 Sepp ..... E04H 15/20 52/2.19
(Continued)

FOREIGN PATENT DOCUMENTS

DE 2154813 A1 5/1973

OTHER PUBLICATIONS

Zepelin, S.R.O.; International Patent Application No. PCT/USSK2018/050003; International Search Report; dated Jun. 15, 2018; (2 pages).

*Primary Examiner* — Joshua K Ihezie
(74) *Attorney, Agent, or Firm* — Dority & Manning, P.A.

(57) ABSTRACT

Inflatable beam (1) comprising fire hoses or other industrial seamless hoses with woven textile braiding, inner air-tight lining and optional outer protective coating, is composed of an assembly of at least three hoses (2) arranged longitudinally side by side, where ends of the hose (2) are closed by a closure (3). At least one of the hoses (2) comprises at least one inlet and/or discharge member (4) for an inflating medium. The hoses (2) are at the point of contact of their circumferences, or at place of the closest distance of their circumferences mechanically connected by stiff connections (5) spaced along the length of the assembly of the hoses (2), at least one length (L) of at least one hose (2) between adjacent connections (5) of the hoses (2) is smaller than the length (M) of the other hoses (2) between these connections (5).

20 Claims, 13 Drawing Sheets

(51) Int. Cl.

| | |
|---|---|
| *E01D 15/12* | (2006.01) |
| *E04C 3/00* | (2006.01) |
| *E04C 3/46* | (2006.01) |
| *E04H 15/20* | (2006.01) |

(56) References Cited

U.S. PATENT DOCUMENTS 4,607,655 A * 8/1986 Wagner ..... E04H 15/20 135/116
4,655,008 A * 4/1987 Parish ..... E04H 15/20 254/93 HP
4,736,762 A * 4/1988 Wayman ..... A61G 10/005 128/205.26
4,918,877 A * 4/1990 Dutka ..... E04H 15/20 285/239
5,743,049 A * 4/1998 Thallemer ..... E04H 15/20 52/2.11
6,192,633 B1 * 2/2001 Hilbert ..... E04H 1/1277 52/2.18
2008/0295417 A1 * 12/2008 Turcot ..... E04H 15/20 52/2.13
2009/0249701 A1 * 10/2009 Turcot ..... E04H 15/20 52/2.18
2009/0300993 A1 * 12/2009 Lamke ..... E04H 15/20 52/2.18
2010/0175330 A1 * 7/2010 Turcot ..... E04H 15/20 52/2.11
2012/0291362 A1 * 11/2012 Milo ..... E04H 15/20 52/2.18
2015/0017338 A1 * 1/2015 Wiliams ..... E04H 5/02 427/421.1
2015/0298406 A1 * 10/2015 Costin ..... B29D 22/02 428/12
2016/0305149 A1 * 10/2016 Brezan ..... E04H 15/54
2019/0376310 A1 * 12/2019 Warner ..... E04C 3/28

* cited by examiner

INFLATABLE BEAM AND USE OF THIS INFLATABLE BEAM

This application is a National Stage Patent Application of PCT/SK2018/050003, filed on Feb. 13, 2018, which claims the benefit of priority to Slovakian Patent Application No. PUV50015-2017, filed on Feb. 14, 2017, the disclosure of which is incorporated by reference herein in its entirety.

TECHNICAL FIELD

The technical solution relates to inflatable beams for ground constructions, in particular for providing of temporary roofings such as tents, hangars, stages and other standard and atypical shelters, as well as for providing auxiliary structures for holding and suspending of technical items and footbridges or for securing other rigid or inflatable construction against falling.

BACKGROUND ART

Inflatable beams are commonly known and used as supporting structures of tents, roofings, shelters, and the like. These inflatable beams are typically tubular, either continually inflated or airtight.

In case of continually inflated beams, the problem is low operating pressure (approx. 1 kPa) and necessary large diameter of the beams related thereto, as well as the need for continual air inflation.

Operating pressure in airtight beams is typically 15 to 40 kPa, what significantly helps to reduce the diameter of the beams. Regarding the strength of the material from which they are made, the higher pressure is however undesirable (destructive), and therefore such beams need to be equipped with overpressure valves. It is common that increased pressure resulting from an increase in air volume during sunny days is compensated by overpressure valves. However, afterwards in cold night hours released air is missing and a tent, its supporting structure respectively, usually collapses.

In order to overcome mentioned problem, seamless inflatable beams with higher operating pressure without a need of pressure compensation through overpressure valves appear to be the most advantageous.

In order to overcome the mentioned disadvantage, e.g. fire hoses are used, which are easily available. The use of fire hoses as a roof structure supports is disclosed in EP 0810339. This solution allows for formation of temporary roofing by means of the structure which comprises inflatable beams, advantageously formed of the fire hoses. These hoses are at their ends connected to rigid supporting elements arranged in a row. When creating the cover for an area, rigid supporting elements are placed along the sides of the area to be covered, whereas these elements also serve as an air supply duct for the said hoses. The hoses are connected with their respective ends to these supporting elements, which after inflating thus form an arc, a series of arches respectively, between said supporting elements. A cover sheet is then fixed upon the series of arches. This solution provides arched cover opened at the ends (a tunnel); however, due to the system of supporting elements it is not suitable for tent structures.

A tent is known from SK 6715 Y1 having inflatable support structure which uses as inflatable beam made of standard fire hose or other industrial seamless hose with outer textile braiding, the hose being closed at each end by a plug, at least one of which comprises air inflation or discharge member, and at least one end of the hose is attached to or placed against the outer cover of the tent or the floor portion of the tent. The use of standard fire hoses or other industrial seamless hoses with outer textile braiding and an internal airtight lining allows for higher operating pressure without a need for pressure compensation by overpressure valves. The shape and overall size of the tent structure is thus defined and does not change even at the pressure fluctuations caused by a change of temperature or pressure of the outside environment. Due to the fact that the tent cover and the floor portion generally form one piece, or the ends of the hose are anchored to the floor portion, the hose is formed into a substantially arcuate shape, in particular according to the shape predefined by the design of outer cover and the floor portion.

The inflatable beam of SK 6715 Y1 provides a relatively inexpensive high strength element for inflatable supporting structures. One disadvantage of the beam as disclosed in the mentioned document is that it can only be used in combination with other tent parts, which will ensure its bending in the arc when this beam is being inflated. This beam as such is not capable to acquire desired shape after inflating, and therefore it cannot be used to form, e.g., a stand-alone arc serving, for example, for holding and suspending of technical items, e.g. lighting.

Though it is obvious that constructions employing the beam of SK 6715 Y1 have high strength and stability with regard to a change of temperature or environment, it is possible to build tents only up to certain dimensions, and it is not possible to use such beam as stand-alone, out of the entire tent structure.

Object of this technical solution is to substantially eliminate deficiencies of the prior art that consist especially in limited use of the inflatable beam formed of standard fire hose or other industrial seamless hose with outer textile braiding, due to its strength and also its own structure.

SUMMARY OF INVENTION

This object is achieved by an inflatable beam according to the present technical solution, characterized in that it is composed of an assembly of at least three fire hoses or other industrial seamless hoses with woven textile braiding and internal air-tight lining and optionally external protective coating, arranged longitudinally side by side, where the ends of the hose are closed by a closure and at least one of the hoses comprises at least one inlet and/or discharge element for an inflating medium, the hoses being at the point of contact of their circumferences, or at place of the closest distance of their circumferences mechanically connected by stiff connections spaced along the length of the hoses, where at least one length of at least one hose between adjacent connections is less than the length of the other hoses between these connections.

The hoses are thus arranged and mechanically bound such that their stability and bending strength is increased and the arcuate or stepped arch shape of the beam is predefined.

Stiff connections of the hoses in a bundle can be both demountable and non-demountable. In the case of a non-demountable connection, it is possible to connect directly the hose braiding in the respective locations either by gluing or sewing. In other words, a stiff connection can be formed directly on the hose surface.

Preferably, the stiff connection of the hose assembly may be provided on a sleeve of the hose, which is immovable relative to the hose. The immovability of the sleeve can be achieved, for example, by tight enclosing of the hose or by providing a stiff connection between the sleeve and the hose, e.g. by gluing, welding (of plastics), sewing, depending on the material used for the sleeve. Such a hose sleeve encloses the outer circumference of the hose and may be made of a variety of suitable materials such as metal, plastic, fabric, composite, and the like. Sleeves themselves can then be connected demountably as well as non-demountably, using suitable technology with respect to the material of the hose sleeve.

In order to improve strength of the beam and stability of the hoses in the assembly, the hose assembly can be enclosed on the outer circumference by at least one sleeve of the hose assembly. This hose assembly sleeve may cover the entire length of the hose assembly, i.e., there substantially is only one on the entire hose assembly. Furthermore, the hose assembly sleeve may cover only a portion of the length of the hose assembly, while there may be only one on the entire length of the hose assembly, or there may be a plurality of such sleeves spaced apart from each other over the entire length of the hose assembly. It is the most preferable, with a plurality of the hose assembly sleeves, to place these sleeves at locations of the stiff connections of the hoses.

The stiff connections of individual hoses in the assembly are preferably chosen so that the inflatable beam has configuration of the hoses, in cross-section, which is the most advantageous for the beam in the inflated state for a given number of hoses in respect of stability of individual hoses in the beam, or also in respect of transversal dimension or the shape of the beam.

Because at least one of the hoses of the assembly has at least one shorter length between adjacent stiff connections than the length of the other hoses of the assembly between these connections, then by connecting the hoses on such portions ensures that the hoses, being inflated, will form the beam into an arc. If in some case said condition for lengths of the hoses between the stiff connections is used only for some portions of the hoses and other portions of the hoses will have the same length of the hoses between the connections in given assembly, then it is also possible to provide a beam in the form of a stepped arc, i.e. arcuate and straight sections will be combined. Radius or curvature of the arc can be suitably pre-selected by adjusting the difference of the lengths of the hoses of the assembly between adjacent stiff connections. When the beam is used as an integral part of a tent, roofing or similar structure, its resulting shape may also be affected by a part of the tent, roofing or similar construction adjacent to the beam, which is e.g. the outer cover of the tent, and possibly the floor of the tent.

The stiff connections of the hoses of the assembly can also serve as points on the beam, with which the beam can be attached to other objects, to a roof parts of a shelter, mutually to other beams, or for suspending objects under the beam.

Besides mechanical connection, individual hoses in the assembly can be mutually pneumatically connected, thus achieving the advantage of central inflation, i.e., inflating through one inflating member on one hose in the assembly. It is also possible to provide pneumatic connections with one-way valves or overpressure valves to increase safety of the beam in case of air leak from one of the hoses.

Closures at the ends of the hose may be made in the form of a closing flange, usually circular according to the cross-section of the hose, a clamp, optionally secured by rolling-up the hose, by using a glue, or may be made by other known ways.

The ends of the hoses in the assembly may preferably be mechanically interconnected, whereby the beam will have stable end. This can be done by mechanically attaching the ends of the hoses to a common platform, e.g. a metal plate, a board, and so, whereby a base is obtained which can be directly anchored to the ground then. It is also possible to place the ends of the hoses in a common case, whereby the base is provided, which is advantageously usable in a tent comprising an integrated floor, where the beam is pushed against a tent cover. With regard to connecting the ends of the hoses, it is possible to connect the ends of all hoses in the assembly or just some of the ends of the hoses.

In order to improve the shape stability of the beam under forces, it is advantageous to tie the hose assembly with a chord. Then, the most preferably between two points of the above-described mechanical connection of the hoses in the assembly.

This technical solution considers air as the most available gaseous medium to be the inflating medium for the hoses. However, it is obvious that other suitable gases can be used, as e.g. Nitrogen or $CO_2$.

The use of standard fire hoses or other industrial seamless hoses with outer textile braiding and internal air tight lining provides for higher operating pressure without a need for pressure compensation by overpressure valves. The shape and strength of the inflatable beam according to this technical solution is therefore sufficiently guaranteed also in the case of pressure fluctuations caused by changes of the ambient temperature or pressure. Operating pressures in individual hoses of the beam according to this technical solution may be in the range of 100 to 1000 kPa, while lower pressure is applied in hoses with greater diameters and higher pressure is applied in hoses with smaller diameters. However, the pressure in the hose is always such that no additional compensation of the pressure in the hose due to changes of the ambient pressure or temperature is in any way necessary.

BRIEF DESCRIPTION OF DRAWINGS

Technical solution is described more in detail in attached drawings, wherein.

DESCRIPTION OF EMBODIMENTS

Figure 2:
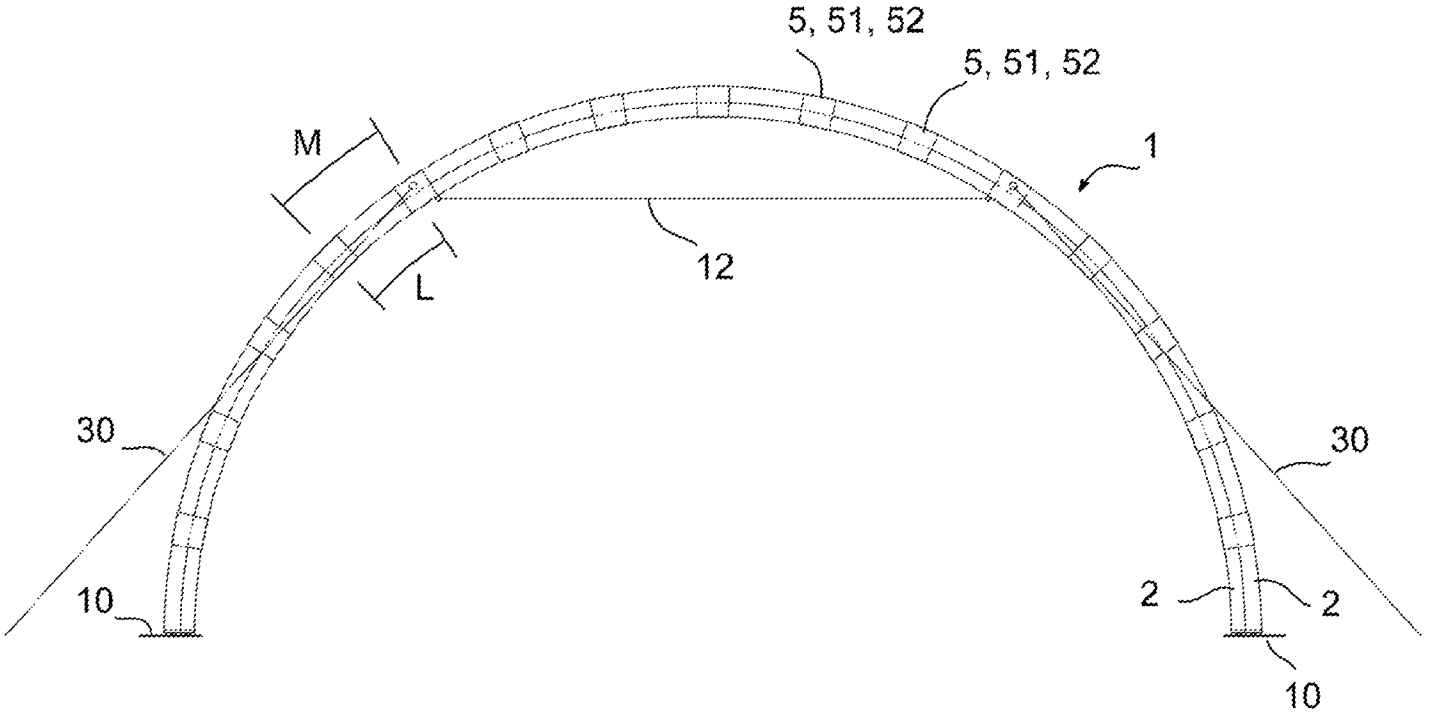
FIG. 2—shows overall front view of the stand-alone beam according to this technical solution.
Figure 3:
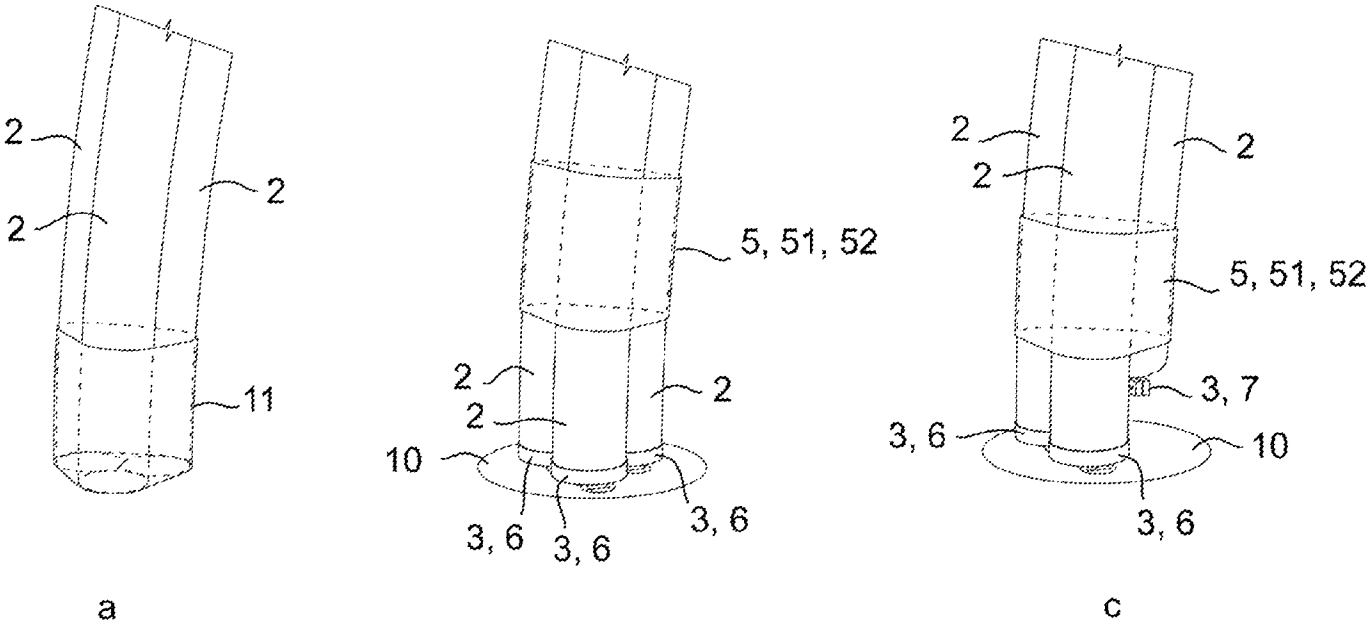
FIG. 3—shows view in axonometry of variants, a, b, c, of mechanic connections of the ends of the beam according to this technical solution.
Figure 4:
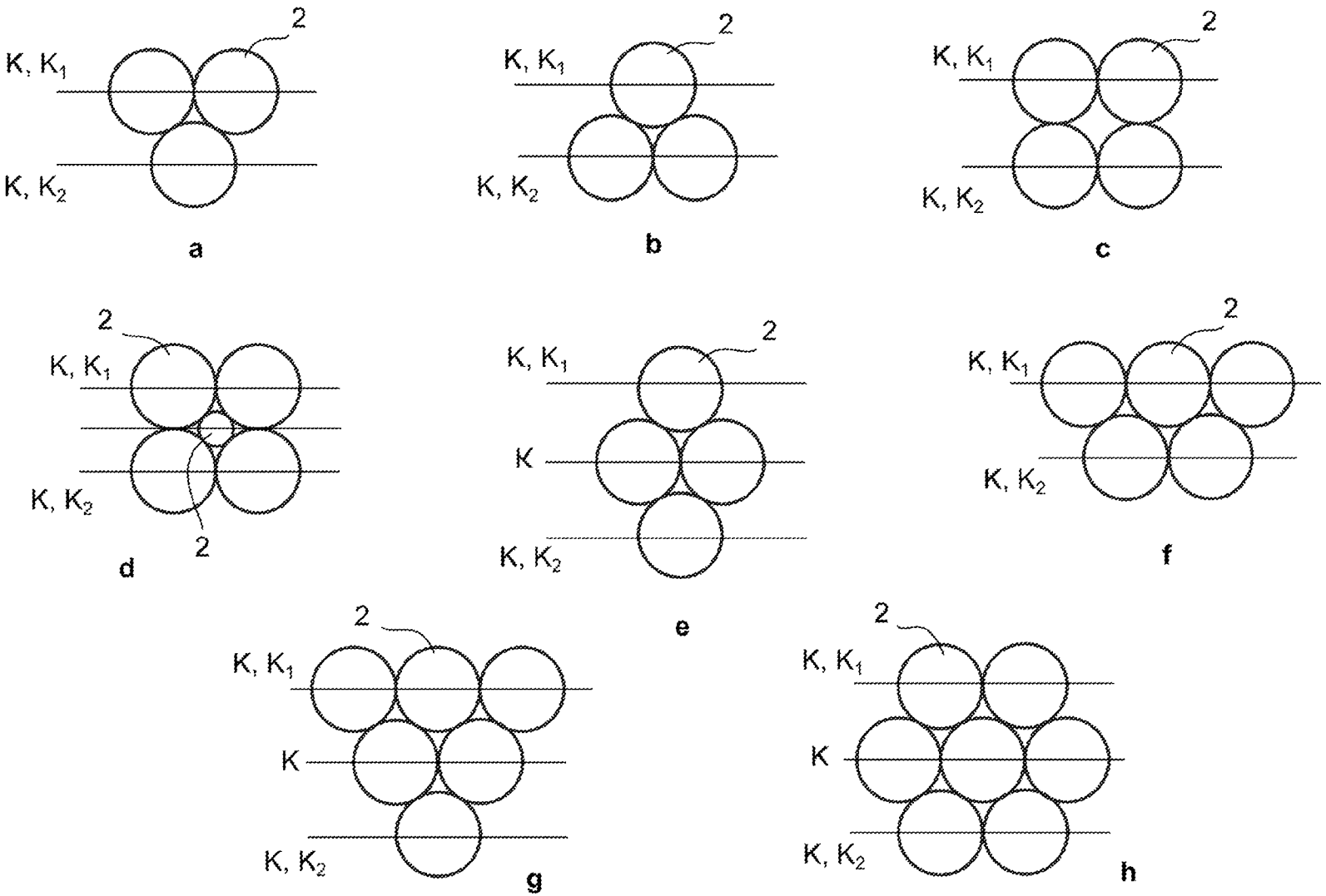
FIG. 4—shows schematic view of variants, a, b, c, d, e, f, g, h, of the arrangement of the hoses in cross-section of the beam according to this technical solution.
Figure 5:
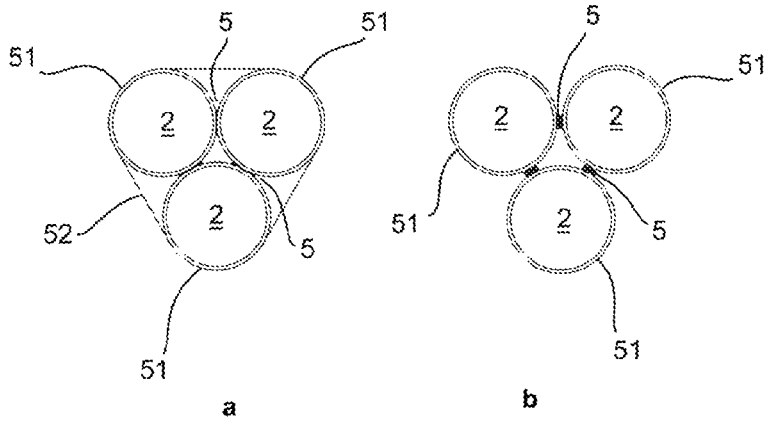
FIG. 5—shows schematic view of variants, a, b, of mechanic connections of the hoses of the beam according to this technical solution.
Figure 7:
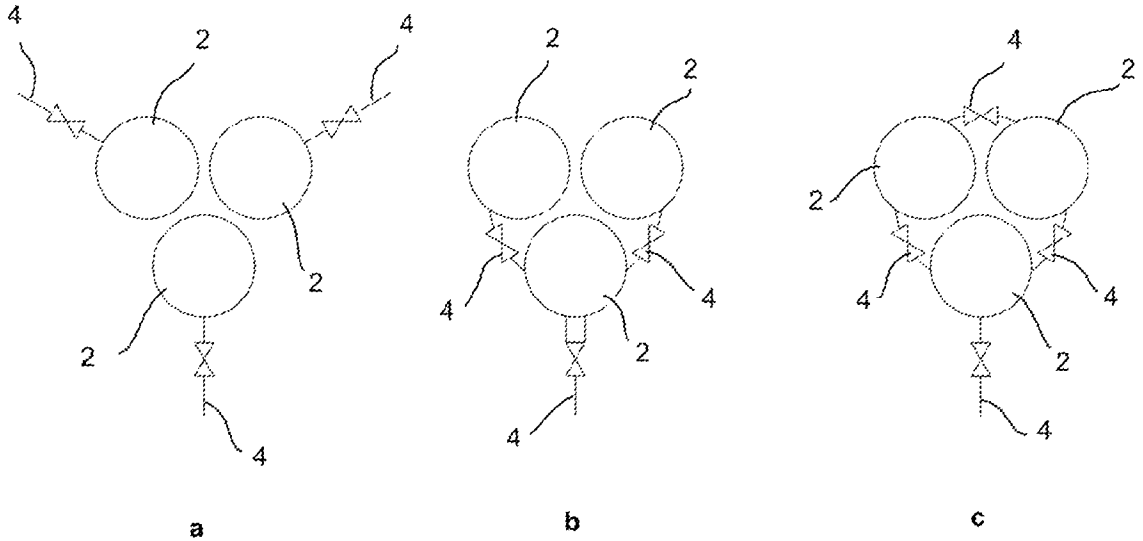
FIG. 7—shows schematic view of variants of pneumatic connections of hoses of the beam according to this technical solution.
Figure 8A:
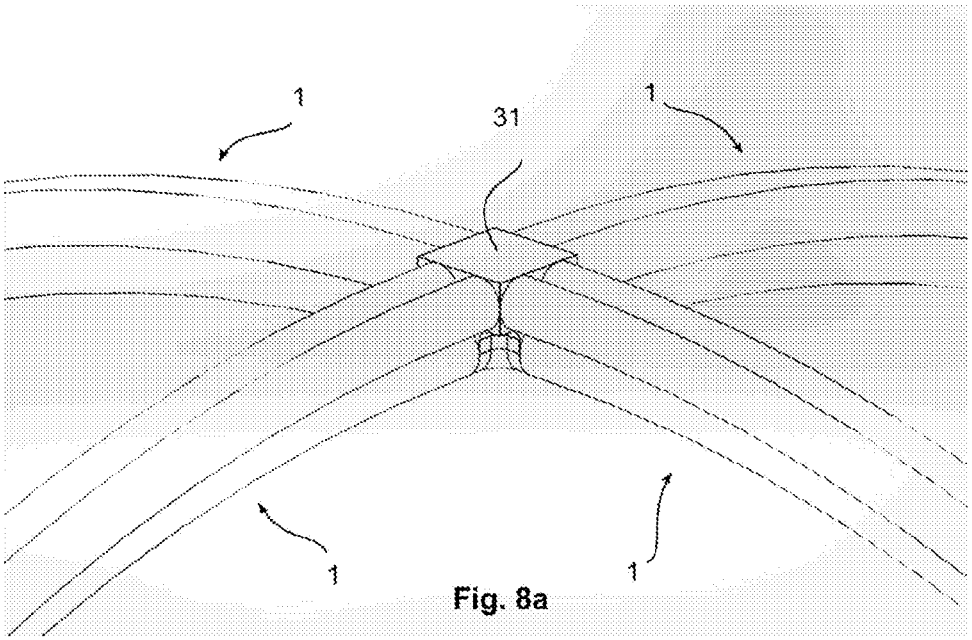
FIG. 8—shows axonometric view of variants of traversing of the beams according to this technical solution, a—having the beams in all directions ended before the point of their crossing, b—having the beams in one direction ended before the point of their crossing, c—having the crossing of the beams elevated.
Figure 8B:
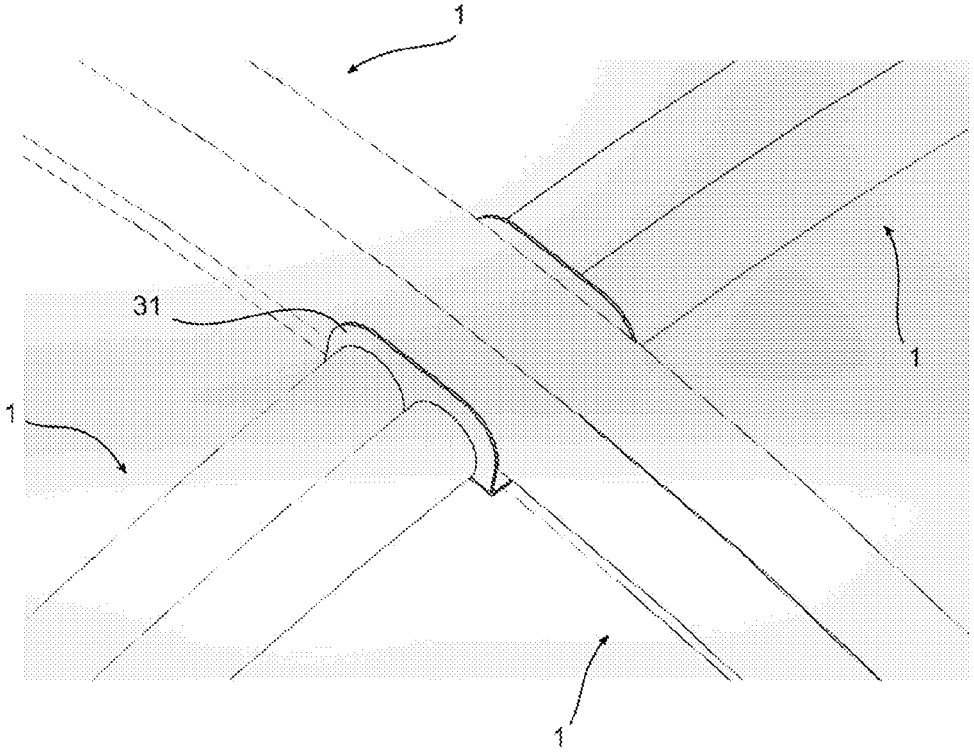
Figure 8C:
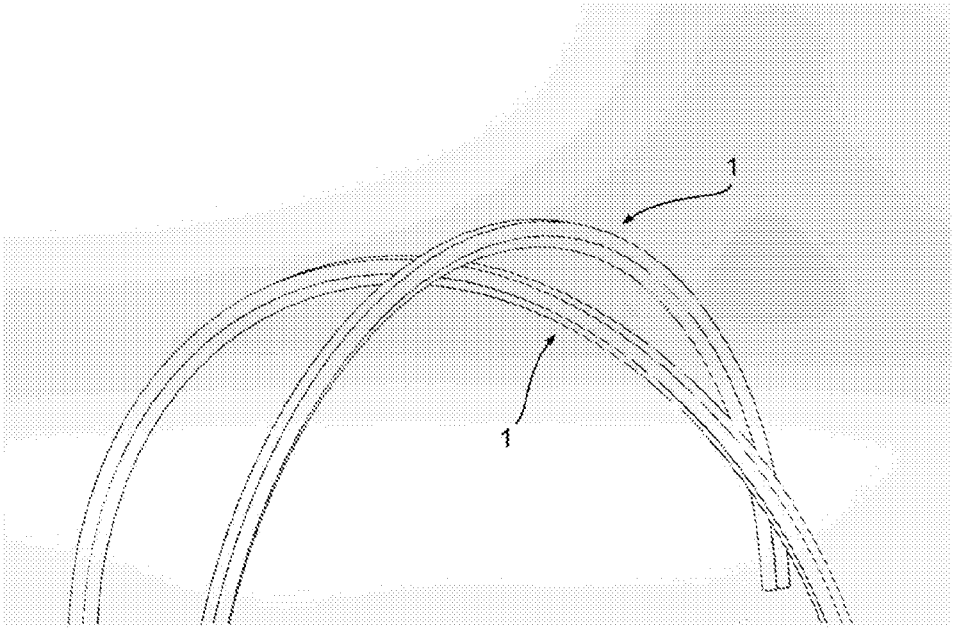

Basic embodiment of the inflatable beam 1 according to this solution comprises three hoses in triangular layout in cross-section, as best seen in FIG. 3, FIG. 4*a, b*, FIG. 5 *a, b*, and FIG. 7. The inflatable beam 1 according to this solution according to FIG. 2 is then composed of the assembly of three fire hoses or other industrial seamless hoses 2 with woven textile braiding and internal airtight lining arranged longitudinally side by side.

Figure 6:
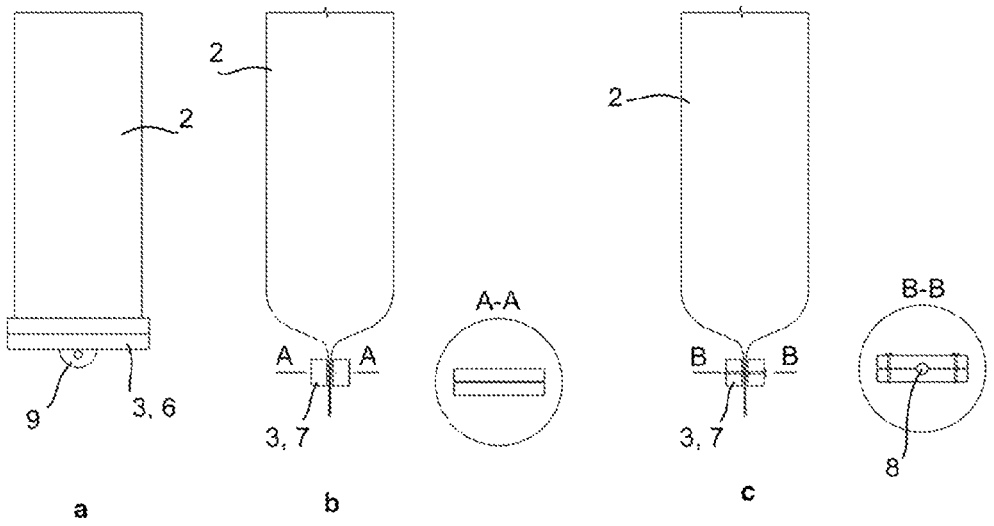
FIG. 6—shows schematic view of variants, a, b, c, of the closures of the ends of hoses with details of sections A-A, B-B of the closures.

Each hose 2 is closed at each of its end by a closure 3. Examples of variants of embodiments of the hose 2 closures 3 are shown in FIG. 6, wherein variant a shows the closure 3 in the form of a closing flange 6, variant b shows the closure 3 in the form of a clamp 7 and variant c shows the closure 3 in the form of the clamp 7 with an air passage 8. Each of the hoses 2 comprises at least one inlet and or discharge member 4 of the inflating medium. Example variants of arrangement of the inlet and/or discharge members 4 are shown in FIG. 7, wherein the variant a shows separate inlet/discharge members 4, valves, for each hose 2 of the beam 1, variant b shows the inlet/discharge member 4 on one hose 2, to which the other hoses 2 are then connected by their respective inlet/discharge members 4, and variant c shows the inlet/discharge member 4 on one hose 2, to which the other hoses 2 are then connected by their respective inlet/discharge members 4, while the other hoses 2 are mutually connected.

The hoses 2 are longitudinally mechanically connected by stiff connections 5 which are spaced apart along the length of the hoses 2, while at least one length L of at least one hose 2 between adjacent stiff connections 5 is smaller than the length M of the other hoses 2 between these connections 5.

Figure 1:
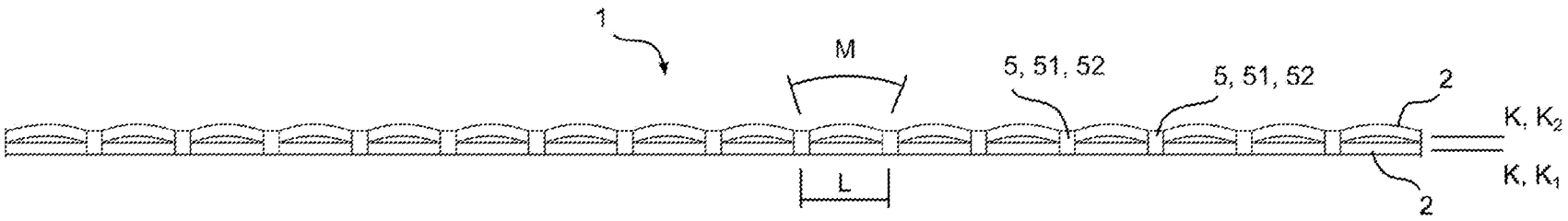
FIG. 1—shows schematic side view of unfolded, not inflated beam according to this technical solution.

The lengths L, M of the hoses 2 in sections between the adjacent connections 5 are different, resulting in that the beam 1 has in the individual layers K composed of the hoses 2 different radius, and thus the whole beam 1 has in inflated state arcuate shape. This is well illustrated in FIG. 1. In this figure, the hose 2, which will form the bottom layer $K_1$ with the smallest radius of the beam 1, is inflated and is straight. The other hoses 2 of the next layer K of the beam 1, i.e. the layers $K_2$ of the hoses 2 of the outer radius of the beam 1, when empty or inflated only partially will form waves between the connecting elements 5 due to their greater length M.

In this embodiment, the inflatable beam 1 is made such that the hoses 2 are at first shortened to calculated total lengths corresponding to the individual layers K of the beam 1, that is to the planned radius of the beam 1. Subsequently, proportional sections are marked, that is lengths L, M on the respective hoses 2 representing a certain percentage portion of the hose with respect to the respective number of the connecting members 5. Finally, the stiff connections 5 are formed on the hoses 2 at marked lengths L and M, by which the hoses 2 of the beam 1 are together firmly connected, i.e. the hoses 2 cannot be displaced relative to each other at the locations of the stiff connections 5. Then, all hoses 2 are inflated to operating pressure, while due to the difference of lengths L, M, between the stiff connections 5, the resulting inflated beam 1 bends into the shape of an arc. If the beam 1 is to have a partially bend shape, thus not a whole arc, then the proportional adjustment of the lengths L and M is made only on some selected sections.

The beam 1 according to this technical solution shown in the accompanying drawings is arcuate along its entire length, that is, all lengths L are smaller than all respective lengths M. However, embodiments of the beam 1 are possible having in one or more sections between the stiff connections 5, the length L equal or substantially equal to the length M. Such adjustments may be advantageous when a modification of the shape of the beam 1 is needed, whereas such straight sections can be formed regularly as well as irregularly, and in any part of the length of the beam 1 as required. Said embodiment of the beam is not shown in drawings, because it is easy to imagine such an arrangement of the beam 1.

Particular example embodiments of the stiff connections 5 are shown in FIG. 5 *a, b*. According to FIG. 5 the stiff connections 5 are formed on sleeves 51 of the hoses 2. The sleeves 51 are tightly enclosed around the hoses 2, or can be attached to the hoses 2 such that to prevent displacement of the sleeve 51 against the hose 2. The sleeves 51 of the hoses 2 are then connected by the stiff connections 5 at points of contact of circumferences of the hoses 2. The point of contact of circumferences of the hose 2 is to be understood in the context of this solution and in the context of the claims as the place of the actual contact either of the own surfaces of the hoses 2, that is the braiding, or the point of contact of surfaces of the sleeves 51, or in the case of making of the stiff connection 5 in other but contact manner, also as a place where circumferences of the hoses 2 are closest to each other, when direct contact of the surfaces of the hoses 2 or the surfaces of the sleeves 51 is not possible due to the presence of a body of the connection itself, such as a screw connection, a pressed connection, and the like.

The stiff connection 5 with contacting surfaces, in this example of the sleeves 51, is shown in FIG. 5*a*, and the stiff connection 5 where the surfaces, in this example of the sleeves 51 are not in contact due to the presence of the body of the connection, e.g. screw connection is shown in FIG. 5*b*.

In the example of FIG. 5*a* particular example embodiment is also shown, where the hose 2 assembly is on its outer periphery enclosed by the sleeve 52 of the hose 2 assembly. This sleeve 52 may be formed as a separate body, i.e. independently of the members of the stiff connection 5 in this example of the sleeves 51, but it can also be formed such that sleeves 51 of the hoses 2 are used that are connected at the locations on the outer circumference of the sleeves 51 with respect to the overall outer shape of the hose 2 assembly.

The resulting beam 1 can be attached to a surface by attaching one or more ends of the hoses 2 to the given surface. This may advantageously be achieved by means of an eye anchor 9 on the closing flange as shown in FIG. 6*a*. In the case that the beam 1 will be attached to the surface by only one hose 2 or only part of the hoses 2, the ends of the hoses 2, not attached to the surface, may be closed by another type of closure 3, e.g. by a clamp 7 as shown in FIGS. 6*b, c*, and FIG. 3*c*.

Regarding stability and strength of the beam 1, it is the most preferable to form the end of the beam 1 by mechanically connecting the ends of more than one hose 2 on a common platform 10. This platform 10 may be, e.g. a metal plate, board, or other, the most preferably flat base, which can then be laid on the surface, and also to secure the position of the beam 1 relative to the surface, anchored to the surface by known ways.

It is also possible to place the ends of the hoses 2 in a common sleeve 11 whereby the end of the beam 1 is obtained, which can be preferably used inside, for example, a tent which comprises integrated floor 26, where the beam 1 is pushed against the tent cover 25. With regard to connecting the ends of the hoses 2 in such a sleeve, it is also possible to connect the ends of all hoses 2 of the beam 1 or only some of the ends of the hoses 2.

The beam 1, in regard of the number of hoses 2 has been described above as the beam 1 with the number of hoses being three, where in the respective figures the layer $K_1$ of the hoses 2, of the inner radius of the beam 1 comprises one hose 2 and the layer $K_2$ of the hoses 2 of the outer radius of the beam 1 comprises two hoses 2.

Total number of the hoses 2 of the beam 1 as well as the number of the hoses 2 in individual layers K of the beam 1 may form various arrangements and may be chosen according to specific requirements on load bearing capacity and stability of the beam 1. Example arrangements of the hoses 2 are shown in the cross-section of the beam 1 in FIG. 4. It is clear that it is possible to provide the beam 1 also with other numbers and arrangement of the hoses 2 as already shown, and also it is possible to use for the assembly the hoses 2 of the same diameter, as well as the hoses 2 with different diameters in respective layers K of beam 1.

Figure 11A:
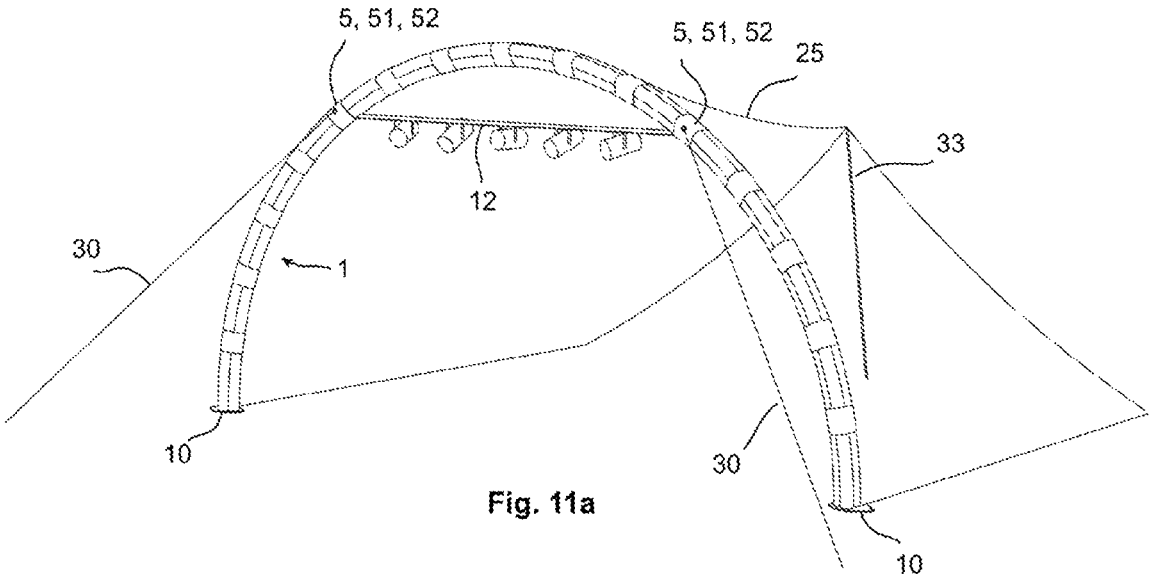
FIG. 11—shows axonometric view of a stage roofing with the beams according to this technical solution, in variants a—with two beams, b—with one beam.
Figure 11B:
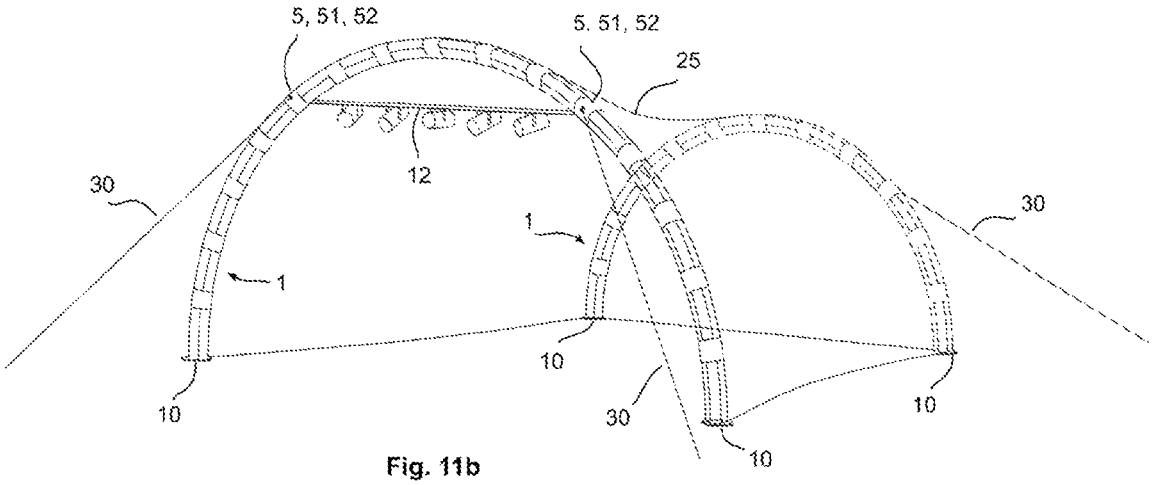
Figure 13:
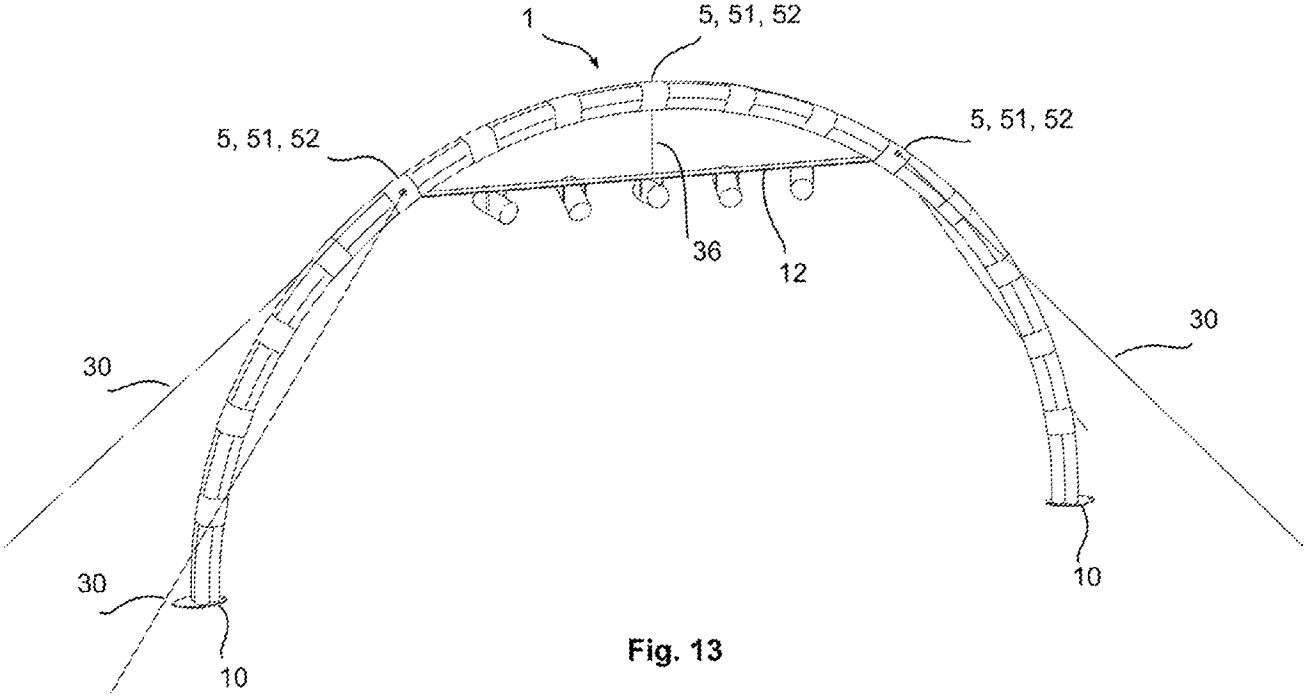
FIG. 13—shows axonometric view of the beam according to this technical solution as a stand-alone support.

In order to improve shape stability of the beam 1 during acting of vertical forces, it is advantageous to tie the hose assembly 2 with a chord 12. Then the most preferable is to attach such chord 12 at the points of the stiff connections 5 of the hoses 2 as shown for example in FIG. 2. The chord 12 can then also serve as a ramp for placing other elements, e.g. stage lighting as shown in FIG. 11 and FIG. 13. This chord 12 for example may have the form of a rope, rigid beam, and the like.

The beam 1 can be used in various applications, the examples of which are shown in FIG. 9 to FIG. 14.

Figure 9:
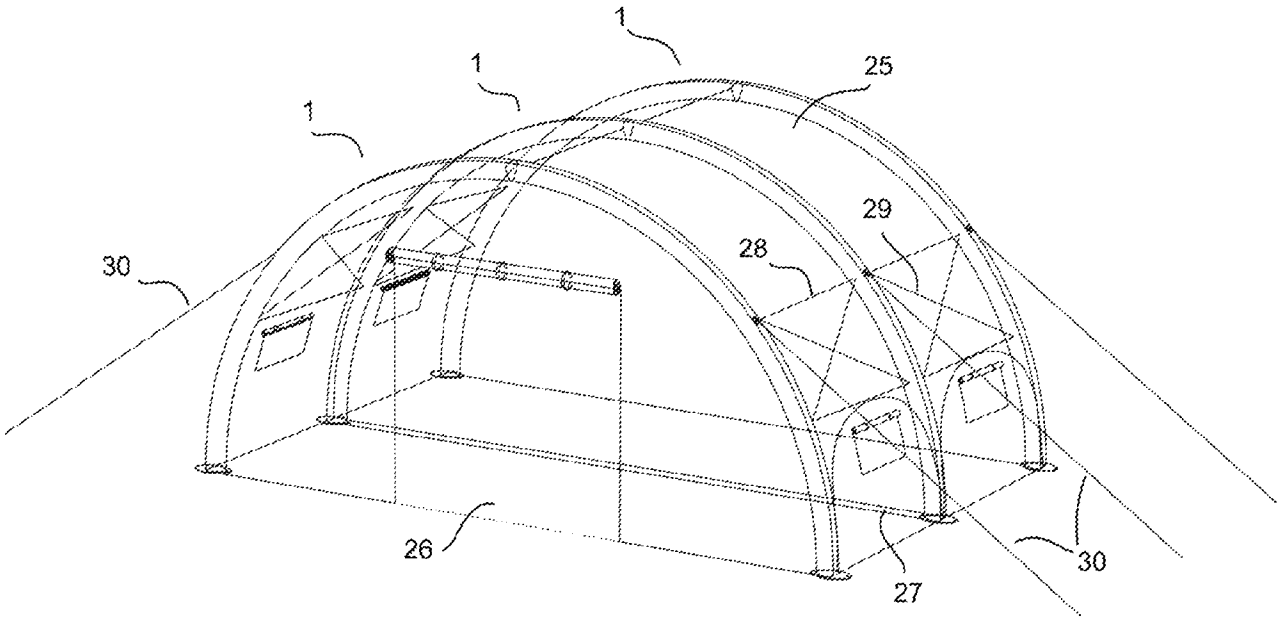
FIG. 9—shows axonometric view of a tunnel-shape tent with the beams according to this technical solution arranged in a row.

FIG. 9 shows the example of use of the beam 1 as part of a tent, hall or hangar with multiple beams 1 arranged in a row one after the other. In this example of embodiment, the beams 1 are placed in the space defined by the outer cover 25 and the floor 26 of the object, while the beam 1 and the outer cover 25 mutually affect each other in regard of the shape. The beams 1 lean against the outer cover 25 on the major part of their length, and the outer cover 25 is attached to the beams 2. The floor 26 of the object defines by its dimension the span of the beam 1. The object can also be made without the floor 26. In this case, it is necessary to attach the ends of the beams 1 for example, to the floor strips 27 of defined length or directly to the ground or other surface. The beams 1 can be mutually spaced by rigid or inflatable spacing members 28. Appropriate design of the outer cover 25, optionally wind bracing 29 between the beams 1 and the outside anchoring 30, will ensure the overall stability of the object even under severe climatic conditions. Fixing of the outer cover 25 to the beam 1 is carried out in known ways, the most preferably at the locations of the stiff connections 5 of the hoses 2 on the beam 1.

Figure 10:
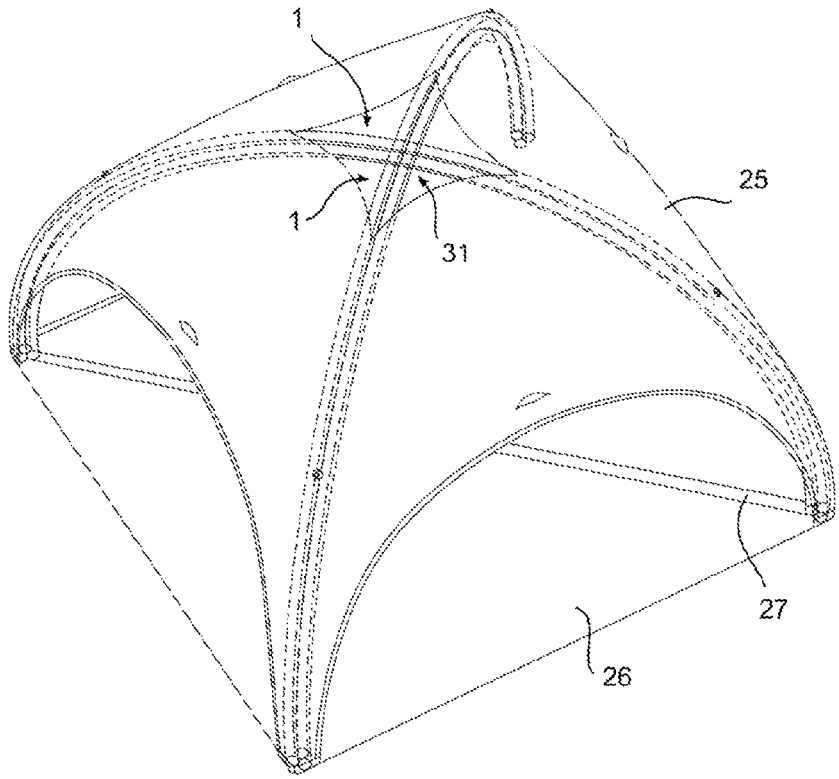
FIG. 10—shows axonometric view of a shelter with the beams according to this technical solution traversed.

FIG. 10 shows use of the beam as part of a tent, hall or roofing with several beams 1 that traverse each other. As in the previous embodiment, also in this example of embodiment, the beams 1 are placed in the space defined by the outer cover 25 and the floor 26 of the object. The spacing and attachment of the beams 1 is also defined identically as in the preceding example. The connecting member 31 of the hose 2 crossing may take different shapes and configurations, dependent in particular on the number of hoses, beams, and junction angle. The most common shapes are e.g. "X" and "T". Respective closures 3 of the hoses 2 on the crossing connecting members 31 may also include inlet and/or discharge member 4. It is of course also possible to traverse the hoses 2 even without the use of the connecting member 31. For example, for the particular example of embodiment of the cupola tent, the connecting member 31 is not used and the beams 1 in this case cross one above the other without being interrupted, optionally only a part of the hoses 2 of the beam 1 is interrupted, thereby the beams 1 mutually engage.

FIG. 11 shows the use of the beam 1 as part of a stage roofing. The inflatable beam 1 is used as the front edge defining the stage visual. From the beam 1, which must be firmly anchored in forward and backward directions, by anchors 30, e.g. by the outer anchoring ropes, the outer cover 25 continues sloping downwards, where it is attached to the support members 33 or to the podium. In the case of a greater depth of the stage, it is possible to arrange two or more inflatable beams 1 in a row including the outer cover 25 as it is with the tunnel tent described above and shown in FIG. 9. From the rear beam 1, the cover 25 continues as described above, or the stage roofing is terminated by the rear beam 1. Any of used inflatable beams 1 may also be used as a carrier for equipment, lighting, signs, and the like.

Figure 12A:
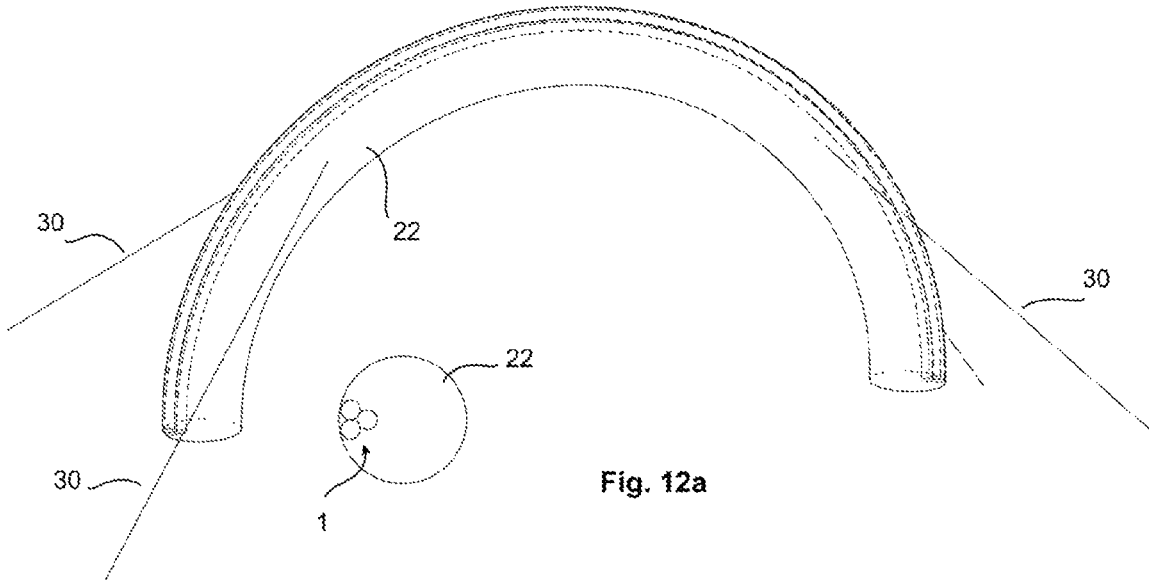
FIG. 12—shows axonometric view of an advertisement inflatable arc with a supporting structure composed of the beam according to this technical solution in variants a—with the beam placed inside the body of the advertisement inflatable arc, b—with the beam placed outside the body of the advertisement inflatable arc.
Figure 12B:
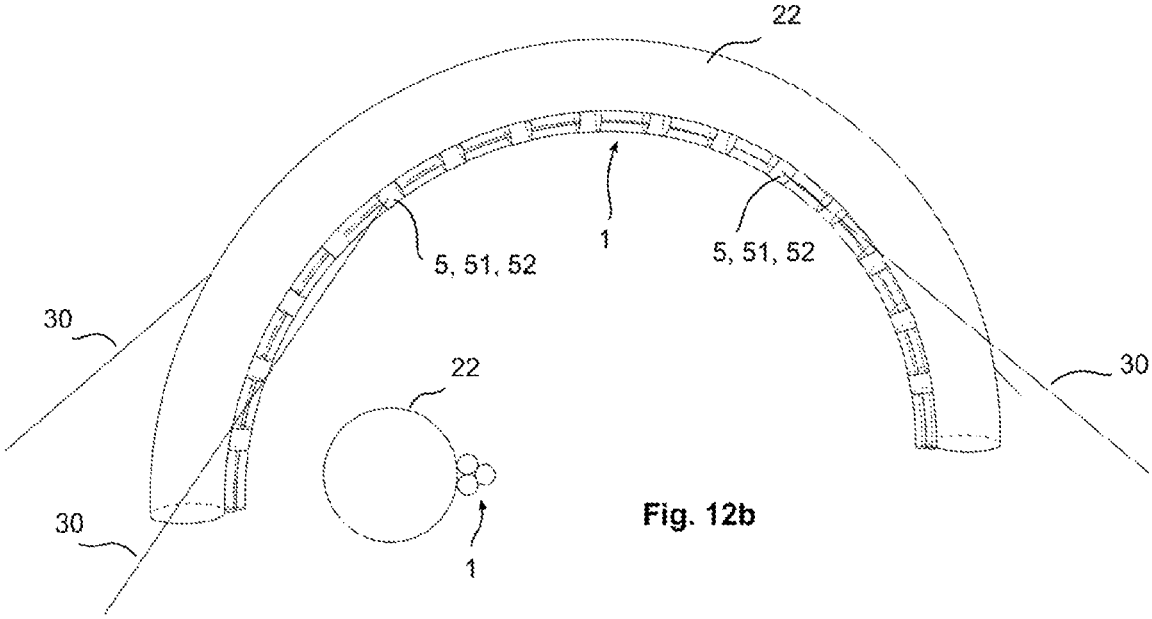

FIG. 12 shows the use of the beam 1 as safety support structure of the advertising inflatable arc 22. FIG. 12*a* shows alternative placement of the inflatable beam 1 within the body of the advertisement inflatable 22, which is inflated to significantly lower pressure. FIG. 12*b* is then alternative placement of the beam 1 as a separate attached element to the body of the advertisement inflatable 22, in particular on the outside of the inner diameter of the arc of the inflatable 22.

The advantage of inside placement in the body of the inflatable 22 is undisturbed design, less exposure to the outside environment, and thus also safety and direct outside anchoring 30 for the case of collapsing the advertisement inflatable 22 due to a power failure or rupture of the cover of the inflatable 22.

FIG. 13 shows the use of the beam 1 as a stand-alone support, which is preferably used, for example, for suspension of audiovisual or lighting equipment, projection screen, advertising signs, and the like. As a stand-alone object, the beam 1 must be firmly anchored in forward and backward directions by outside anchors 30. In particular, in FIG. 13, lights are mounted on the chord 12, while the chord 12 is hung on the beam 1 on the suspension member 36, which can be e.g. a rope, in order to increase the load bearing capacity.

Figure 14:
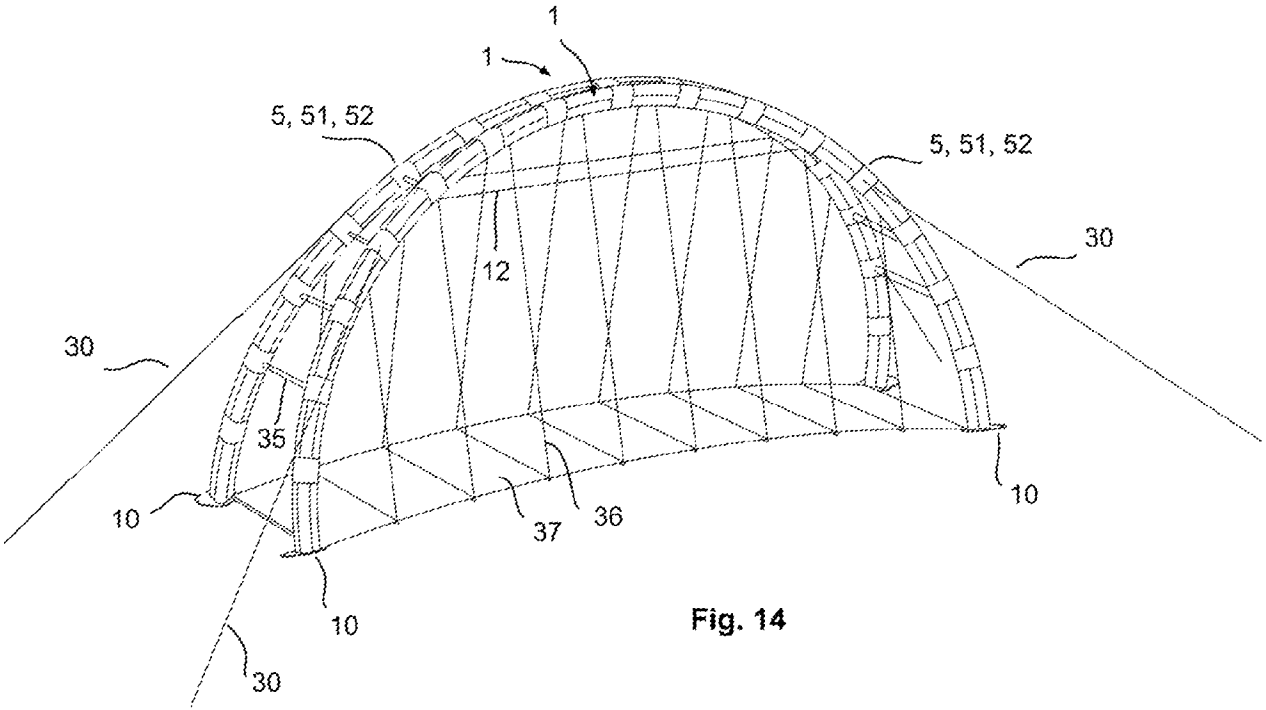
FIG. 14—shows axonometric view of an arrangement of the beams according to this technical solution serving as arcuate supporting structure for suspended footbridge.

FIG. 14 shows the use of an assembly of two arcuate beams 1 as a support for a temporary suspended footbridge 37, for example, in the case of destruction of the bridge during the flood. The beams 1 shown in the example are led parallel and inclined to each another and at the highest point they are in contact and at the same time they are spaced apart in direction to their end by horizontal spacers 35. An embodiment is also possible, where the beams 1 are inclined to each other but are not in contact, as well as an embodiment where the beams 1 are parallel to each other with the same length of the horizontal spacers 35 over the entire length of the beams 1. The footbridge 37 suspension members 36, e.g. ropes, are led from the beams 1, the most preferably form the locations of the stiff connections 5. Ends of the beams 1 are attached to the ground through the platform 10 and the ends of the footbridge 37 are attached thereto or to the plane thereof. In order to increase safety, it is also advantageous to anchor the entire assembly by outside anchors 30.

The above-mentioned examples of embodiments are introduced for illustrative purposes only, without limiting the scope of protection defined by the claims in any way. It is clear that by exploitation of principles described in this technical solution, it is possible to create great number of applications with the use of the beam 1 beside those, which are described as particular examples of use of the beam 1 according to this technical solution.

The beam 1 according to this technical solution provides rigid and stable structure member especially for temporary constructions, where simple logistics, quick installation and labor savings are important factors.

The invention claimed is:

1. An inflatable beam comprising industrial seamless hoses with woven textile braiding and an inner air-tight lining wherein the beam comprises an assembly of at least three hoses arranged longitudinally side by side, where ends of the hose are closed by a closure, and at least one of the hoses comprises at least one inlet for an inflating medium, the hoses being at the point of contact of their circumferences, or at place of the closest distance of their circumferences mechanically connected by a plurality of stiff connections spaced along the length of the assembly of the hoses apart from the closure, wherein at least one length of at least one hose between adjacent connections of the hoses is smaller than the length of one or more other hoses between these connections, wherein the at least one hose extends beneath one or more of the other hoses to form an inflated arc.

2. The inflatable beam according to claim 1, wherein the closures comprise a closing flange, clamp, or glued joint.

3. The inflatable beam according to claim 1, wherein the hoses are mutually pneumatically connected.

4. The inflatable beam according to claim 3, wherein the mutual pneumatic connections of the hoses comprise closing, one-way or overpressure valves.

5. The inflatable beam according to claim 1, wherein the stiff connection is provided on the surface of the hose, or on a sleeve of the hose attached to the hose.

6. The inflatable beam according to claim 1, wherein the assembly of the hoses is on its outer periphery enclosed by at least one sleeve.

7. The inflatable beam according to claim 6, wherein the sleeve of the assembly of the hoses covers the entire length of the assembly of the hoses, or the sleeves cover part of the length of the assembly of the hoses and are placed at the locations of the stiff connections.

8. The inflatable beam according to claim 1, wherein the ends of at least of two hoses are mechanically connected.

9. The inflatable beam according to claim 8, wherein the mechanical connection of the ends of the hoses is comprised of the closures of the hoses connected to a common platform.

10. The inflatable beam according to claim 8, wherein the mechanical connection of the ends of the hoses is comprised of a sleeve, in which the ends of the hoses are placed.

11. The inflatable beam according to claim 1, wherein the hoses have the same diameter.

12. The inflatable beam according to claim 1, wherein the hoses have different diameters.

13. Use of the beam according to claim 1, for building a tent, hall, or hangar with the beams in a row.

14. Use of the beam according to claim 1 for building a tent, hall, or roofing with the beams, which are mutually traversed.

15. Use of the beam, according to claim 1 for building of a front edge of a stage roofing.

16. Use of the beam according to claim 1 for building of a supporting structure of an advertisement inflatable arc.

17. Use of the beam according to claim 1 for building of a stand-alone arcuate support.

18. Use of the beam according to claim 1 for building of supporting structure of a suspended footbridge.

19. An inflatable beam comprising:

a plurality of industrial seamless hoses comprising three or more industrial seamless hoses, each industrial seamless hose comprising an inner air-tight lining and woven textile braiding extending about the inner air-tight lining, the plurality of industrial seamless hoses extending along an overall first length from a first end to a second end;

a closure sealing at least one hose of the plurality of industrial hoses at the first end or the second end;

a common platform mechanically connecting the plurality of industrial seamless hoses at the first end or the second end; and a plurality of stiff connections spaced along the overall length between the first end and the second end, each stiff connection mechanically connecting the plurality of industrial seamless hoses apart from the common platform and the closure, wherein at least one length of at least one hose between adjacent stiff connections is smaller than the length of the other hoses between these connections, and wherein the at least one hose extends beneath one or more of the other hoses to form an inflated arc.

20. An inflatable beam comprising:

a plurality of industrial seamless hoses comprising three or more industrial seamless hoses, each industrial seamless hose comprising an inner air-tight lining and woven textile braiding extending about the inner air-tight lining, the plurality of industrial seamless hoses extending along an overall first length from a first end to a second end;

a closure sealing at least one hose of the plurality of industrial hoses at the first end or the second end;

a common platform mechanically connecting the plurality of industrial seamless hoses at the first end or the second end;

a plurality of stiff connections spaced along the overall length between the first end and the second end, each stiff connection mechanically connecting the plurality of industrial seamless hoses apart from the common platform and the closure; and a sleeve extending over the plurality of industrial seamless hoses and one or more of the plurality of stiff connections, wherein at least one length of at least one hose of the plurality of industrial seamless hoses between adjacent stiff connections is smaller than a length of the other hoses of the plurality of industrial seamless between the adjacent connections, and wherein the at least one hose extends beneath one or more of the other industrial seamless hoses to form an inflated arc.

* * * * *